US011497256B2

(12) United States Patent
Tereshchenko

(10) Patent No.: US 11,497,256 B2
(45) Date of Patent: Nov. 15, 2022

(54) MEANS FOR SUPPORTING A TROUSER CREASE

(71) Applicant: RONOLMA HOLDINGS LTD, Limassol (CY)

(72) Inventor: Vladimir Tereshchenko, Moscow (RU)

(73) Assignee: RONOLMA HOLDINGS LTD, Limassol (CY)

( * ) Notice: Subject to any disclaimer, the term of this patent is extended or adjusted under 35 U.S.C. 154(b) by 70 days.

(21) Appl. No.: 15/557,435

(22) PCT Filed: Mar. 11, 2016

(86) PCT No.: PCT/EP2016/055366
§ 371 (c)(1),
(2) Date: Sep. 11, 2017

(87) PCT Pub. No.: WO2016/142539
PCT Pub. Date: Sep. 15, 2016

(65) Prior Publication Data
US 2018/0027890 A1 Feb. 1, 2018

(30) Foreign Application Priority Data
Mar. 11, 2015 (GB) ..... 1504120

(51) Int. Cl.
*A41D 1/10* (2006.01)
*A41D 27/14* (2006.01)

(52) U.S. Cl.
CPC ..... *A41D 1/10* (2013.01); *A41D 27/145* (2013.01)

(58) Field of Classification Search
CPC ..... A41D 1/10; A41D 1/06; A41D 27/145; A41D 27/14; A41D 2300/50
USPC ..... 2/231
See application file for complete search history.

(56) References Cited

U.S. PATENT DOCUMENTS

| | | | | |
|---|---|---|---|---|
| 492,514 A | | 2/1893 | Leavitt | |
| 1,981,784 A | * | 11/1934 | Dodington | A41D 1/10 2/231 |
| 2,597,179 A | | 5/1952 | Michael | |
| 3,064,270 A | * | 11/1962 | Chalfin | A41B 3/06 2/260 |
| 3,372,402 A | * | 3/1968 | Kaufmann | A41D 1/082 2/232 |
| 3,883,381 A | * | 5/1975 | Thaeler | A41H 37/06 156/66 |

(Continued)

FOREIGN PATENT DOCUMENTS

| | | |
|---|---|---|
| CN | 201691087 | 1/2011 |
| FR | 1178920 | 5/1959 |

(Continued)

OTHER PUBLICATIONS

Examination Report issued in Application No. GB1504120.5, dated Jan. 22, 2018 (2 pages).

(Continued)

*Primary Examiner* — Khoa D Huynh
*Assistant Examiner* — Uyen T Nguyen
(74) *Attorney, Agent, or Firm* — Fish & Richardson P.C.

(57) ABSTRACT

A trouser leg comprising a slit that incorporates a stiffening element, the slit being positioned such that, in use, the slit sits either side of a wearer's shoe, which stabilises the stiffening element and causes it to resist lateral movement of the trouser leg above the shoe.

12 Claims, 6 Drawing Sheets

(56) References Cited

U.S. PATENT DOCUMENTS

| | | | | |
|---|---|---|---|---|
| 5,114,057 | A * | 5/1992 | Ishikawa | A41H 37/06 223/37 |
| 5,794,268 | A | 8/1998 | Pessey | |
| D461,944 | S * | 8/2002 | Williams, Jr. | D2/858 |
| D598,178 | S * | 8/2009 | Cutlip | D2/742 |
| D614,378 | S * | 4/2010 | Viola | D2/742 |
| 7,861,324 | B2 * | 1/2011 | Chetelat | A41C 1/14 2/231 |
| 7,900,277 | B1 * | 3/2011 | O'Brien | A41F 17/00 2/273 |
| 8,413,266 | B2 * | 4/2013 | Solotoff | A41D 1/06 2/227 |
| D734,918 | S * | 7/2015 | Korman | D2/742 |
| D751,273 | S * | 3/2016 | Ramon | D2/742 |
| 2006/0200950 | A1 * | 9/2006 | Kousaka | A44B 19/12 24/396 |

FOREIGN PATENT DOCUMENTS

| | | |
|---|---|---|
| FR | 2724823 | 3/1996 |
| GB | 163771 | 5/1921 |
| GB | 2125273 | 3/1984 |
| JP | S6251114 | 11/2015 |

OTHER PUBLICATIONS

Examination Report in Appln. No. 16709467.1-1017, dated Jan. 15, 2019, 4 pages.

Examination Report issued in Appln. No. GB1504120.5, dated Aug. 30, 2016, 3 pages.

International Search Report in International Appln. No. PCT/EP2016/055366, dated Apr. 12, 2016, 3 pages.

Written Opinion in International Appln. No. PCT/EP2016/055366, dated Sep. 11, 2017, 5 pages.

* cited by examiner

MEANS FOR SUPPORTING A TROUSER CREASE

CROSS-REFERENCE TO RELATED APPLICATIONS

This application is a National Stage Application under 35 U.S.C. § 371 and claims the benefit of International Application PCT/EP2016/055366, filed on Mar. 11, 2016, which claims priority to Great Britain Application 1504120.5, filed on Mar. 11, 2015. The disclosures of the foregoing applications are hereby incorporated by reference in their entirety.

This invention relates to a trouser leg and a method of manufacturing a trouser leg.

Smart pairs of trousers often incorporate a crease, which runs down the front of each trouser leg. The aim is to produce an essentially unbroken vertical line down the front of each trouser leg that is aesthetically pleasing. Trousers of this sort are often hang loosely, i.e. rather than being in close contact with the wearer's legs, as in more figure-hugging styles, the trouser legs are largely unsupported by the wearer's body during use. A consequence of this is that the trouser legs may move sideways and twist slightly during as the wearer moves around. Any such sideways movement can be rendered more noticeable by the trouser crease, which instead of hanging vertically straight down may show signs of twisting. This is particularly undesirable in trousers that are designed to have a smart appearance.

U.S. Pat. No. 2,597,179 describes a means for keeping a trouser crease straight to the knee. It consists of a string or thread that attaches to the inner seam of each trouser leg. These strings are likely to cause some discomfort to the wearer, however, and be impractical when dressing and undressing. GB 163,771 describes a metal ring for being inserted into a turn-up at the bottom of a trouser leg to maintain the shape of the front and rear creases. This metal ring is thus only able to be used if the trouser leg has a turn-up, which many do not. The ring is also likely to cause discomfort and irritation to the wearer if it bangs the ankle during use.

Therefore, there is a need for an improved trouser leg.

According to a first embodiment, there is provided a trouser leg comprising a slit that incorporates a stiffening element, the slit being positioned such that, in use, the slit sits either side of a wearer's shoe, which stabilises the stiffening element and causes it to resist lateral movement of the trouser leg above the shoe.

The trouser leg may be configured such that, in use, it hangs loosely from the wearer's knee to the slit.

The trouser leg may incorporate a crease that extends upwardly from the slit.

The stiffening element may be formed of a different material from a remainder of the trouser leg.

The slit may comprise two edges, each of which is angled away from a central axis of the slit.

The angle may be between 5 and 25 degrees.

The slit may be between 1 and 3 cm in length.

According to a second embodiment, there is provided a method of manufacturing a trouser leg comprising designing the trouser leg, including: selecting a length of a slit to be formed in the trouser leg; selecting a stiffening element to be incorporated into the slit; and determining a length of the trouser leg such that, in use, the slit will sit either side of a wearer's shoe so as to stabilise the stiffening element and cause it to resist lateral movement of the trouser leg above the shoe; and materially producing the trouser leg so designed.

The present invention will now be described by way of example with reference to the accompanying drawings. In the drawings.

Figure 4A:
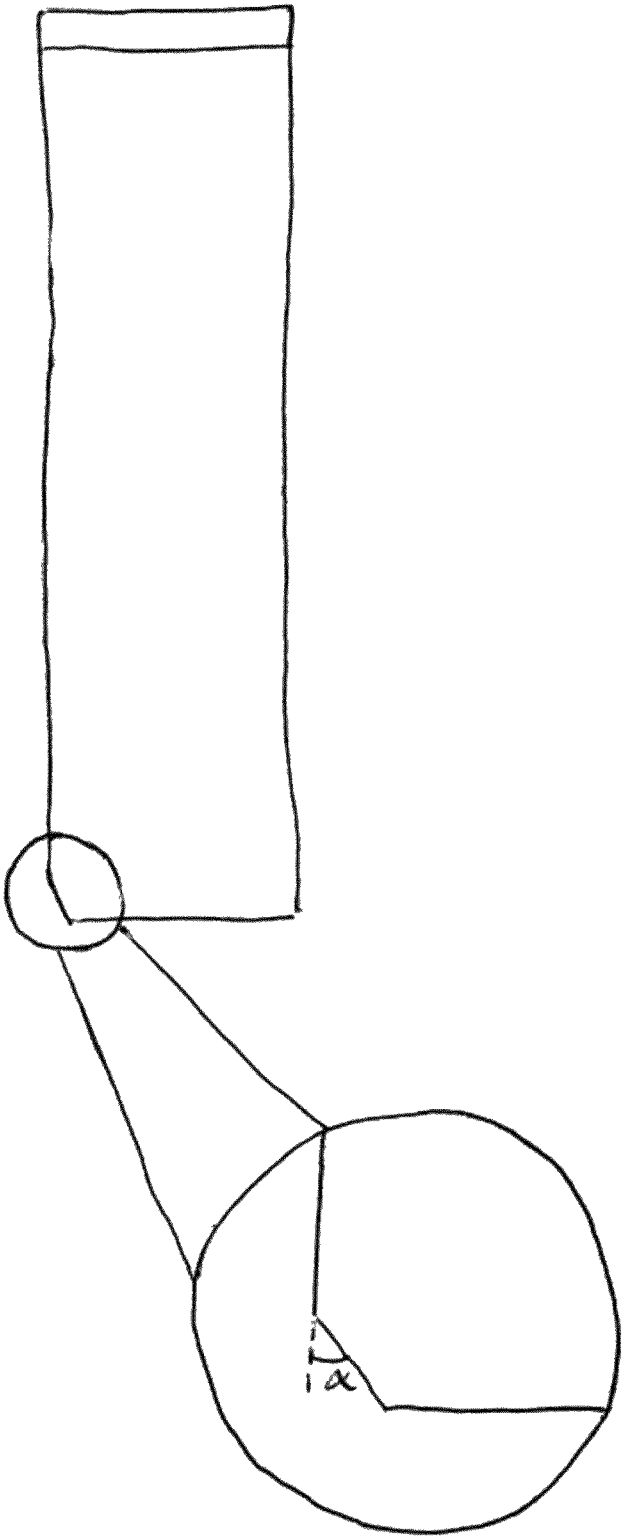
Figure 4B:
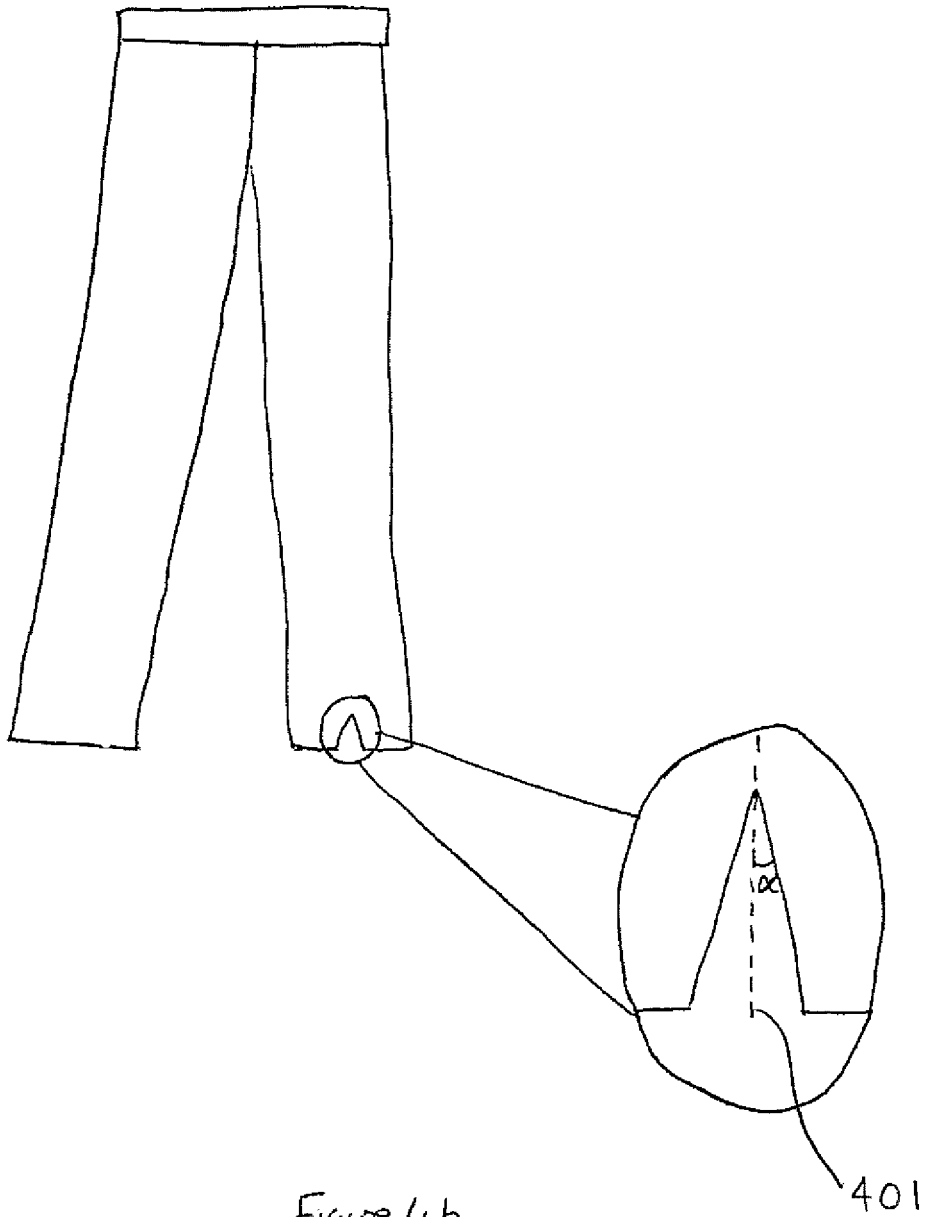
Figure 5:
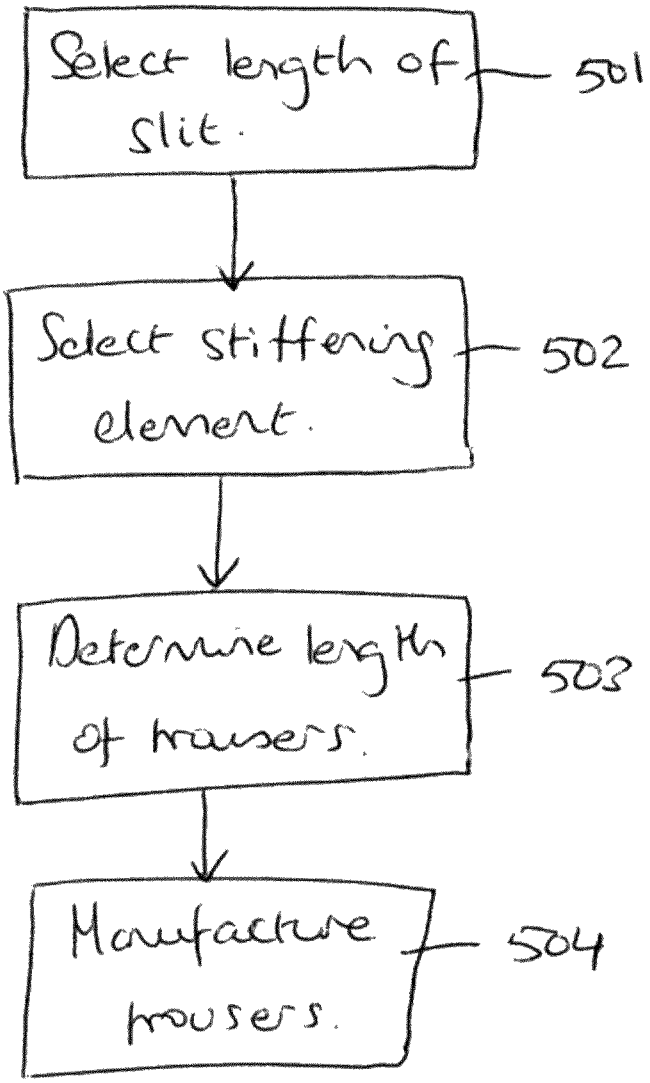

FIG. 4*a* shows a side view of a flattened trouser leg comprising an angled slit;

FIG. 4*b* shows a front view of a flattened trouser leg comprising an angled slit; and FIG. 5 shows an example of a method of manufacturing a trouser leg.

Figure 6:
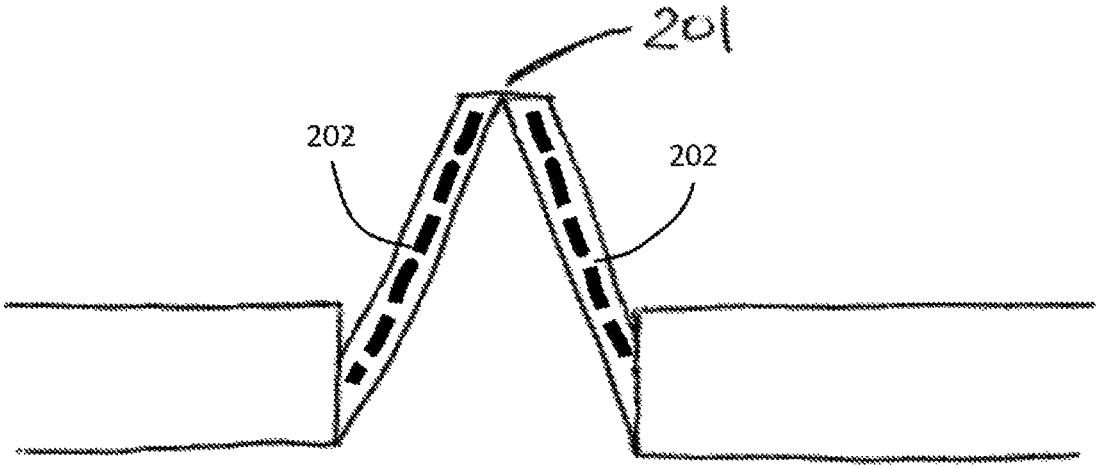

FIG. 6 shows an example of the construction of a slit that has stiffening elements.

In the description below various features of a pair of trousers are described in relation to their position with respect to each other and a pair of trousers as a whole. It should be understood that when relative terms such as "upper" or "lower", "top" or "bottom" are used, this is intended to refer to the relative position of the various features if the trousers are orientated in accordance with how they would conventionally be worn, i.e. with the waistband positioned above the trouser legs. This is the orientation shown in the figures. It should be understood, therefore, that if this description applies to a pair of trousers when orientated in the way in which those trousers would typically be worn, it is equally applicable to those same trousers in any other orientation.

Figure 1:
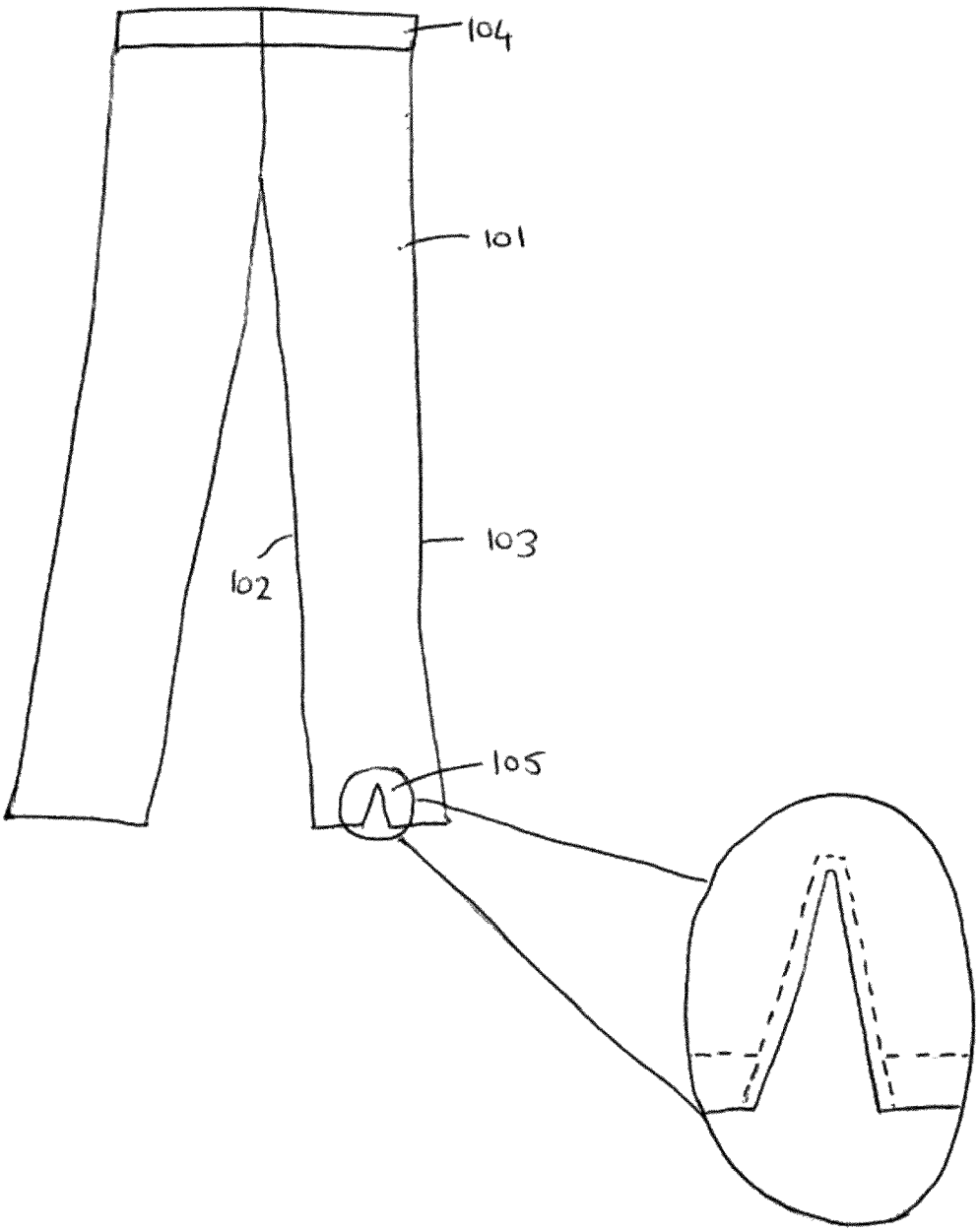
FIG. 1 shows a front view pair of trousers in which one of the trouser legs comprises a slit.

An example of a pair of trousers is shown in FIG. 1. The trousers comprise two trouser legs 101. Each trouser leg is essentially a fabric tube configured to encase a wearer's leg. This tube could be formed from a single fabric panel but it is more usual for each trouser leg to be formed from two panels of fabric, which are stitched together. Conventionally the two panels are stitched together to form an inner seam 102 and an outer seam 103. The two trouser legs are joined by a waistband 104.

Figure 3:
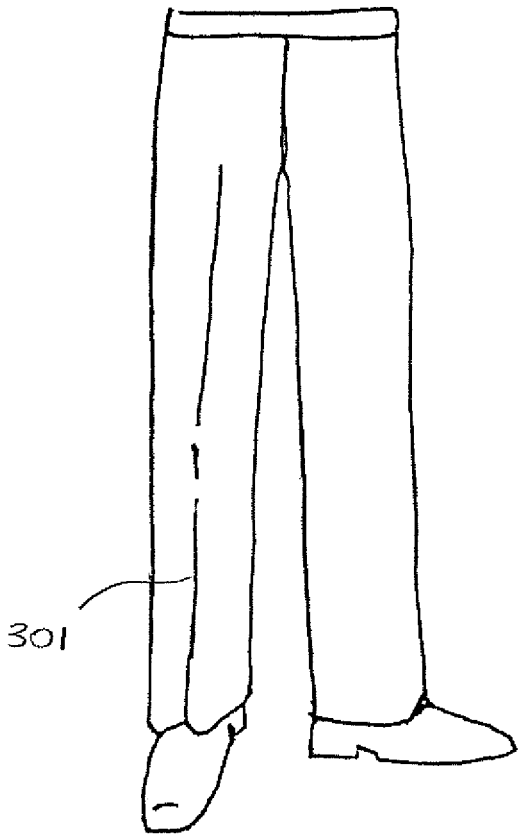
FIG. 3 shows a pair of trousers comprising a slit.

One of the trouser legs comprises a slit 105. This slit is positioned at the bottom of the trouser leg and extends upwards towards the waistband. The slit is preferably positioned so that, when the trousers are being worn, the slit sits either side of the wearer's shoe. This is illustrated in FIG. 3. In this arrangement each of the slit's two edges contacts the shoe along at least part of its length while the trousers are being worn. The edges of the slit are thus supported by the shoe.

The term "slit" is used herein to not only refer to the physical cut in the fabric of the trouser leg but also the construction surrounding that cut that enables the slit to resist sideways movement of the trouser leg above (as will become apparent from the description below).

An illustration of the trousers being worn is shown in FIG. 3. One of the advantages of the slit at the bottom front of each trouser leg is that it allows the trousers to be long enough to cover the top of the shoe at the back and sides without crumpling over the front of the shoe. Instead the slit allows the bottom of the trousers to sit neatly over the front of the shoe.

Figure 2:
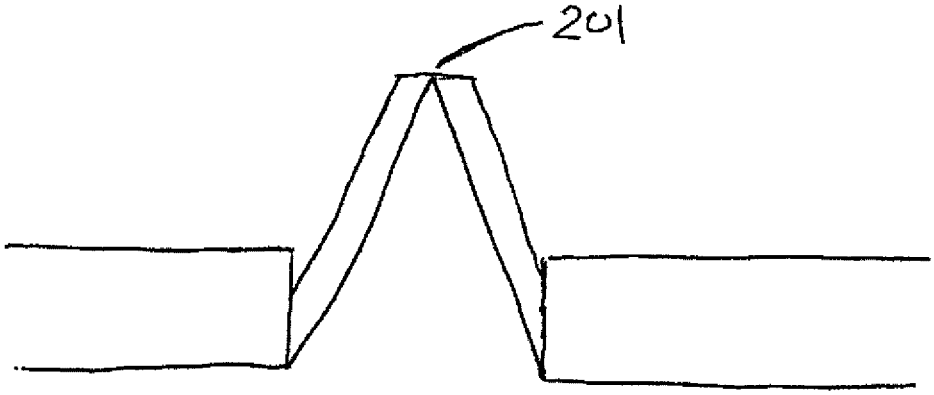
FIG. 2 shows an example of the construction of a slit.

A possible construction of the slit is shown in the magnified section of FIG. 1. The dotted lines represent stitching. In this example the slit has been cut into the fabric panel that forms the front of the trouser leg. The two edges of that slit have been folded back and stitched to form a hem to prevent fraying. An example of how this arrangement might look from the interior of the trouser leg is shown in FIG. 2. Other methods for preventing fraying may also be employed, such as using binding or tape. Equally the slit may be cut into a panel made of a fabric that does not have a tendency to fray. The tip of the cut 201 might also be reinforced.

In some implementations any stitching to hold a hem along an edge of the slit may be largely invisible from the outside of the trouser leg. This may be achieved by having only small stitches showing on the outside or by matching the colour of the thread to the colour of the surrounding fabric. In other implementations the stitching may be a visible design feature, e.g. by having a thread that contrasts with the colour of the surrounding fabric and/or by using tightly spaced stitching or multiple rows of stitching.

In a preferred example the slit incorporates some form of stiffening element (e.g., 202 in FIG. 6) that renders the edge portions of the slit stiffer than the fabric from which it is formed (including if that fabric were folded, such as when doubled-up to form a hem). In some implementations this stiffening element may take the form of a different material, such as binding or interfacing. The stiffening element might not be fabric. For example, it could be formed of metal or plastic. The stiffening element may be applied to the edge portions of the slit by being attached to the fabric, e.g. via stitching or glue. It may be held within a double layer of the fabric, such as a hem. In some examples the stiffening element may be removable. For example, the stiffening element may be an elongated piece of material inserted into a receiving pouch in a similar manner to a collar stiffener being inserted into a shirt collar. A stiffening element may also be incorporated into the slit by impregnating the edge portions of the slit with a chemical that stiffens the fabric. Examples include starch, glue, gelatine and a variety of commercially available fabric stiffeners. Other possibilities include the stiffening element being provided by a particular form of stitching, applied to the edge regions of the slit, which has the effect of making those regions stiffer than the surrounding fabric. A stiffer thread could also be woven into the regions of the trouser leg surrounding the slit, e.g. a thread formed from fine metal strands.

The stabilising effect of having the edges of the slit contacting the shoe in use is strengthened by the stiffening element. It is possible for the shoe to exert a greater amount of force against the edges of the slit than it could without the stiffening element, due to the increased firmness that the stiffening element provides to those edges. This is particularly true if the trousers are formed of a limp fabric that would otherwise offer little resistance to the shoe. With the stiffening element incorporated, the slit should remain positioned either side of the wearer's shoe even as the wearer moves around. In use, the top of the trouser leg is substantially fixed in position by the waistband. The effect of the reinforced slit is to substantially fix the position of the bottom of the trouser leg too. Thus the slit acts to resist lateral movement of the trouser leg, helping to keep the trouser leg in the correct position during use.

The stabilising effect of the slit may be especially beneficial in trousers that are relatively loose. A trouser leg that hangs loosely from the wearer's knee downwards is more likely to be susceptible to lateral movement of the trouser leg during use than closer-fitting styles. (For the avoidance of any doubt, the expression "from the knee" does not preclude that the trouser leg might be loosely hanging about the knee too).

For figure-hugging trousers, close contact with the wearer's legs provide support that can in itself resist lateral movement of the trouser leg during use.

The trousers may be formed of any fabric—natural or man-made—including wool, cotton, linen, polyester etc. The trouser design described herein may be particularly advantageous for trousers formed from a material that has little inherent stiffness, i.e. a fabric that has a natural tendency to drape. Fabrics of this type may be particularly prone to lateral twisting of the trouser leg during use due to the lack of stiffness in the fabric. Also, it is often fabrics with these kind of draping properties that are used to make trousers incorporating a crease.

The stabilizing effect of the slit may be particularly advantageous in a trouser leg that incorporates a crease running along its length. This is because the crease is usually intended to form a crisp line running vertically down the center of the trouser leg, so lateral movement of the trouser leg is more noticeable in trousers with a crease as that movement causes the crease to twist. An example is shown in FIG. 3. By resisting lateral movement of the trouser leg about the wearer's shoe, the slit also resists twisting of the crease 301. Thus the slit helps the crease 301 to remain substantially straight and vertical in use.

In FIG. 1, the slit is formed from a cut straight along an axis of the trouser leg. Another option is for the slit to be angled. This is shown in respective side and front views in FIGS. 4*a* and *b*. In the illustrated example, the slit is formed at an angle $\alpha$ to the central axis of the slit 401 (when the trouser leg is worn, this axis will be substantially vertical). If the trouser leg is flattened for viewing from the front (as shown in FIG. 4*b*), this angle creates an opening at the front of the trouser leg that accommodates the wearer's shoe. This prevents the slight bunching of excess fabric that might otherwise occur. Slight bunching of his kind could create slack in the fabric that would permit some lateral movement of the trouser leg to occur despite the resistance offered by the slit. It also provides a pleasing aesthetic effect since the trouser leg is able to hang directly onto the wearer's shoe in a substantially unbroken line. The angle $\alpha$ is preferably between 5 and 25 degrees, more preferably between 10 and 20 degrees and most preferably between 12.5 and 17.5 degrees.

The slit is preferably relatively short so that, when the trouser leg is being worn, the slit is in contact with the wearer's shoe along the majority of its length. Preferably the slit is sufficiently short that, in use, each edge of the slit is in contact with the wearer's shoe along at least 75% of its length. More preferably the slit is sufficiently short that, in use, each edge of the slit is in contact with the wearer's shoe along at least 80% of its length. Most preferably the slit is sufficiently short that, in use, each edge of the slit is in contact with the wearer's shoe along at least 90% of its length. In absolute terms, the slit is preferably less than 10 cm long, more preferably less than 5 cm long and most preferably less than 3 cm long. Suitably the slit may be between 1 and 3 cm in length.

A method of manufacturing a trouser leg such as that described herein is shown in FIG. 5. The method initially comprises steps relating to designing the trouser leg. The length of a slit to be formed in the trouser leg is selected (step 501). Preferably this length is selected so that the slit will be able to sit either side of the wearer's shoes without extending much beyond that. The aim is to have the sides of the slit touch the shoe along most of their length during use. A suitable stiffening element is then selected for being incorporated into the slit (step 502). The final step of the design n process shown in FIG. 5 is then to determine an appropriate length for the trouser leg so that, in use the slit will sit either side of the wearer's shoe (step 503). The length of the trouser leg may be tailored to the particular individual who is intending to wear the trousers to achieve the optimum support for the trouser above. The correct length will also be determined to some extent by the length of the slit that has been selected. Tailoring the length in this way is also likely to result in the neatest appearance, with the trouser leg able to drop directly onto the wearer's shoe without bunching around the ankle. The step of determining an appropriate length for the trouser leg may also optionally incorporate determining an appropriate width (not shown). Suitably the trouser leg should be wide enough, at least at the bottom, so that the slit can sit either side of the wearer's shoe. If the trousers are too narrow for a particular wearer, such that they bunch around the wearer's ankle, the slit may not sit either side of the wearer's shoe and provide support for the upper parts of the trouser leg as intended. Finally a pair of trousers is suitably produced to the design (step 504).

The trousers described herein may be worn with any type of footwear but may be particularly suitable for being worn with high-fronted shoes such as lace-ups. The trousers are suitable for men and women.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. A trouser leg comprising a slit at the bottom front of the trouser leg, wherein the slit incorporates two stiffening elements, the slit being positioned such that, in use, the slit sits either side of an exterior of a wearer's shoe and is configured to stabilize the stiffening elements and cause them to resist lateral movement of the trouser leg above the shoe, wherein the slit has a constant length, and the slit comprises two edges, each of which is angled away from a central axis of the slit, the angle being between 5 and 25 degrees, and wherein each of the two edges includes a receiving pouch, and each stiffening element comprises an elongated piece of material that is inserted into the receiving pouch.

2. The trouser leg as claimed in claim 1, the trouser leg being configured such that, in use, it hangs loosely from the wearer's knee to the slit.

3. The trouser leg as claimed in claim 1, the trouser leg incorporating a crease that extends upwardly from the slit.

4. The trouser leg as claimed in claim 1, the stiffening element being formed of a different material from a remainder of the trouser leg.

5. The trouser leg as claimed in claim 1, the slit being between 1 and 3 cm in length.

6. The trouser leg as claimed in claim 2, the trouser leg incorporating a crease that extends upwardly from the slit.

7. A trouser leg comprising a slit at the bottom front of the trouser leg, wherein the slit incorporates two stiffening elements, the slit comprising a left edge and a right edge, the slit is positioned such that, in use, the left edge of the slit sits on a left side of an exterior of a wearer's shoe, and the right edge of the slit sits on a right side of an exterior of the wearer's shoe, wherein the stiffening elements are configured to reinforce the slit, and the reinforced slit is configured to fix the position of the bottom of the trouser leg to resist lateral movement of the trouser leg, and wherein the slit has a constant length, and each of the left edge and the right edge is angled away from a central axis of the slit, the angle being between 5 and 25 degrees, and wherein each of the left edge and right edges includes a receiving pouch, and each stiffening element comprises an elongated piece of material that is inserted into the receiving pouch.

8. The trouser leg of claim 7 in which the trouser leg is configured such that, in use, it hangs loosely from the wearer's knee to the slit.

9. The trouser leg of claim 7 in which the trouser leg incorporates a crease that extends upwardly from the slit.

10. The trouser leg of claim 7 in which the stiffening element is formed of a different material from a remainder of the trouser leg.

11. The trouser leg of claim 7 in which the slit is between 1 and 3 cm in length.

12. The trouser leg of claim 1 in which the slit is formed in a fabric that forms a front of the trouser leg, and the edges of the slit are folded back and stitched to form a hem.

* * * * *